US006753778B2

(12) United States Patent
Kruger

(10) Patent No.: US 6,753,778 B2
(45) Date of Patent: Jun. 22, 2004

(54) ORIENTATION/TIME SENSING ALARM DEVICE FOR GOLF CLUB

(76) Inventor: Douglas Brown Kruger, 1238 NW. 19th Ter., Delray Beach, FL (US) 33445

( * ) Notice: Subject to any disclaimer, the term of this patent is extended or adjusted under 35 U.S.C. 154(b) by 78 days.

(21) Appl. No.: 09/874,023

(22) Filed: Jun. 6, 2001

(65) Prior Publication Data

US 2002/0186132 A1 Dec. 12, 2002

(51) Int. Cl.[7] ..... G08B 13/14

(52) U.S. Cl. ..... 340/568.6; 340/527; 340/568.1; 340/583; 340/689

(58) Field of Search ..... 340/568.6, 689, 340/686.1, 506, 511, 527, 568.1, 571, 573, 583

(56) References Cited

U.S. PATENT DOCUMENTS

| | | | | |
|---|---|---|---|---|
| 3,707,055 A | | 12/1972 | Pearce | 46/228 |
| 3,710,371 A | | 1/1973 | Whalen et al. | 340/283 |
| 3,971,006 A | | 7/1976 | Pressly | 340/224 |
| 4,135,079 A | | 1/1979 | McGraw | 219/327 |
| 4,291,301 A | * | 9/1981 | Chan | 340/568.1 |
| 4,558,307 A | * | 12/1985 | Lienart van Lidt de Jeude | 340/527 |
| 4,675,656 A | | 6/1987 | Narcisse | 340/539 |
| 4,692,745 A | * | 9/1987 | Simanowitz | 340/568.7 |
| 5,068,643 A | * | 11/1991 | Yashina | 340/571 |
| 5,089,808 A | * | 2/1992 | Amirdash | 340/573.7 |
| 5,175,868 A | | 12/1992 | Yasuoka | 455/38.2 |
| 5,235,321 A | * | 8/1993 | Rowan et al. | 340/571 |
| 5,356,343 A | | 10/1994 | Lovetere | 472/57 |
| 5,554,975 A | * | 9/1996 | Hall et al. | 340/573.7 |
| 5,635,897 A | | 6/1997 | Kuo | 340/311.1 |
| 5,781,109 A | | 7/1998 | Nakajima | 340/568 |
| 5,796,338 A | | 8/1998 | Mardirossian | 340/568 |
| 5,801,627 A | | 9/1998 | Hartung | 340/568 |
| 5,861,808 A | * | 1/1999 | Lehmann et al. | 340/571 |
| 5,952,921 A | * | 9/1999 | Donnelly | 340/568.6 |
| 6,040,772 A | | 3/2000 | Jackson et al. | 340/568.8 |
| 6,114,967 A | | 9/2000 | Yousif | 340/690 |
| 6,118,376 A | | 9/2000 | Regester | 340/568.8 |
| 6,118,386 A | | 9/2000 | Yousif | 340/690 |

* cited by examiner

*Primary Examiner*—Daniel J. Wu
*Assistant Examiner*—Son Tang
(74) *Attorney, Agent, or Firm*—Yi Li

(57) ABSTRACT

An orientation/time sensing alarm device is provided, which comprises an orientation sensor, a time sensor connecting to the orientation sensor, and an alarm connecting to the orientation sensor and the time sensor, forming a circuitry. The time sensor is activated by the orientation sensor when the orientation sensor senses the alarm device is above a predetermined orientational threshold. The alarm is activated when the time sensor senses the duration of activation of the time sensor being above a predetermined timing threshold. Also provided is a self-reminding golf club having an orientation/time sensing alarm device connected to the grip of the golf club for reminding a golfer of a misplaced golf club.

12 Claims, 2 Drawing Sheets

ORIENTATION/TIME SENSING ALARM DEVICE FOR GOLF CLUB

FIELD OF THE INVENTION

The present invention relates to golf club reminding devices, and more particularly to an orientation/time sensing alarm device and its use for reminding mis-positioned golf clubs.

BACKGROUND OF THE INVENTION

During a round of golf, a golfer uses a number of different clubs to address various obstacles and situations that arise. It is common for a golfer to remove more than one clubs from the golf bag when considering how best to approach a shot. It is also common for a golfer to temporarily place a club on the ground when raking a sand trap, replacing a divot, holding a flag, watching a drive or lining up a shot. If the golfer forgets to retrieve the club, the club can become misplaced, and even lost. These and other common practices in a round of golf can lead to the misplacement of a gold club.

In the prior art, several types of devices exist for warning golfers that a glof club has removed from a glof bag and has not been returned. For example, U.S. Pat. Nos. 5,565,845 (to Hara) and 5,028,909 (to Miller) disclose devices that have sensors installed within a golf bag for detecting the presence of each golf club, and an alarm for warning a golfer when a club is missing from the bag. This type of device has several disadvantages. With this type of device, the golf bag needs to be equipped with receptacles and sensors for receiving and detecting individual clubs. The device also requires that a club must be returned to an appropriate receptacle in order for the device to function properly.

U.S. Pat. Nos. 6,118,376 (to Regester) and 5,952,921 (to Donnelly) disclose another type of club reminding system that comprises multiple transmitters, each attached to a golf club, a transceiver being carried by a golfer or attached to a golf bag or a golf cart, and an alarm. These systems operate based on a distance sensing mechanism. The transceiver continuously or periodically monitors the distance between the transmitters and the transceiver, and triggers alarm if the monitored distance is above a predetermined threshold distance.

These systems overcome the disadvantages associated with those devices that only have sensors embedded within a golf bag. However, these systems require continuous operation of the sensors for constantly or periodically monitoring the distance between the transmitters and transceiver. To effectively assist a golfer to trace all his golf clubs during a play, the sensors are most likely kept on during the entire play. This continuous operation consumes battery, particularly the button battery used to support the transmitters attached to the golf clubs. It can be very costly and inconvenient to maintain the system because each golf club needs a transmitter.

Therefore, it is apparent there exists a special need for more effective and less expensive golf club reminding devices that can be conveniently utilized by the golf players.

SUMMARY OF THE INVENTION

In one aspect, the present invention relates to an orientation/time sensing alarm device adaptable to a golf club, which comprises an orientation sensor, a time sensor connecting to the orientation sensor, and alarm. The time sensor is activated by the orientation sensor when the orientation sensor senses the golf club being positioned in a direction with an angle from a horizontal plane less than the predetermined threshold angle. The alarm is activated when the time sensor senses the duration of activation of the time sensor is above a predetermined timing threshold.

In another aspect, the present invention relates to a self-reminding golf club. The self-reminding golf club comprises a golf club, and orientation/time sensing alarm device connected to a grip of the golf club, wherein the orientation/time sensing alarm device comprises an orientation sensor, a time sensor connecting to the orientation sensor, and an alarm. The time sensor is activated by the orientation sensor when the orientation sensor senses the golf club being positioned in a direction with an angle from a horizontal plane less than the predetermined threshold angle. The alarm is activated when the time sensor senses a duration of activation of the time sensor is above a predetermined timing threshold.

In a further aspect, the present invention relates to an orientation/time sensing alarm device. The orientation/time sensing alarm device comprises an orientation sensor, a time sensor connecting to the orientation sensor, an alarm connecting to the orientation sensor and the time sensor forming a circuitry, and an on/off switch. The time sensor is activated by the orientation sensor when the orientation sensor senses the device is above a predetermined orientational threshold. The alarm is activated when the time sensor senses duration of activation of the time sensor being above a predetermined timing threshold.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
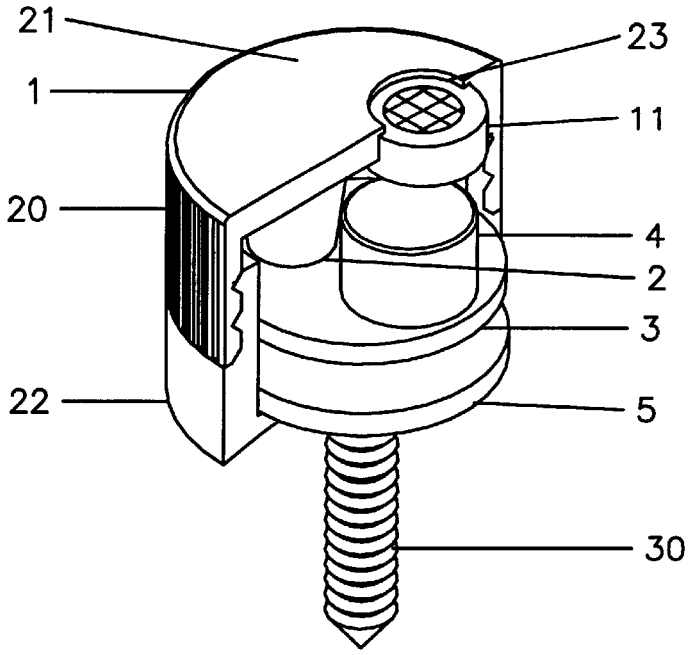
FIG. 1 is an exploded perspective view of the orientation/time sensing alarm device of one embodiment of the present invention.

In one embodiment, the present invention relates to an orientation/time sensing alarm device adaptable to a golf club for reminding a golfer of a misplaced golf club. FIG. 1 shows an exploded perspective view of the orientation/time sensing alarm device 1 of one embodiment of the present invention. The orientation/time sensing alarm device comprises an orientation sensor 2, a time sensor 3 connecting to orientation sensor 2, and an alarm 4 connecting to orientation sensor 2 and time sensor 3 to form a circuitry. The circuitry is powered by battery 5.

As shown, the orientation/time sensing alarm device further comprises cover 20, which has top 21 and base 22. On the exterior of base 22, cover 20 has an attachment means. In one embodiment as shown in FIG. 1, the attachment means is a screw or a threaded stud located at the center of the base, for connecting device 1 to where the function of device 1 is sought for. However, other attachment means can also be utilized. Suitable examples include adhesives, magnets, and multiple screws, or studs. Cover 20 can be in any suitable shape, dimension and color, which are appropriate for where device 1 is used for.

The orientation/time sensing alarm device further comprises an on/off switch for controlling activation and deactivation of the device. In one embodiment the on/off switch is a light sensor 11 as shown in FIG. 1. In this case cover 20 has an opening 23 on top 21. Light sensor 11 is installed with the light sensing element of the sensor facing opening 23 for receiving light signals. The light sensor activates orientation/time sensing alarm device 1 when light sensor 11 receives light signals above a predetermined light signal threshold. Sensitivity of the light sensor can be selected or preset depending on the utility of the orientation/time sensing alarm device. Suitable examples of light sensor include photoconductive cells. These are common light sensors commercially available.

Orientation sensor 2 can be a tilt sensor enabling electrical contacts. Suitable examples of tilt sensor include mercury tilt sensor, ball tilt sensor, accelerometer, tilt sensor using radio frequency excited electrolyte, and other electronic orientational sensing device. Time sensor 3 can be an electronic timer, a microprocessor with a timing circuitry, or other suitable electronic timing device.

Figure 2:
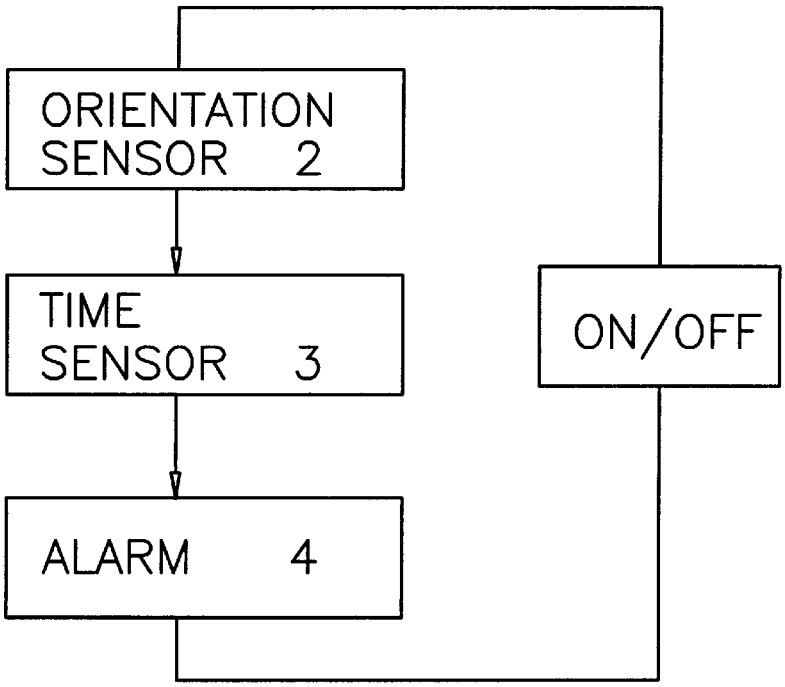
FIG. 2 is a schematic operation flow diagram of the orientation/time sensing alarm device of one embodiment of the present invention.

FIG. 2 shows a schematic operation flow diagram of the orientation/time sensing alarm device. When the on/off switch or light sensor activates device 1, orientation sensor 2 is in function. Time sensor 3 is activated by orientation sensor 2 when the orientation sensor senses device 1 is above a predetermined orientational threshold. Once activated, the time sensor measures the period of time from the moment of its activation. When the time sensor senses the time period is above a predetermined timing threshold, it activates alarm 4. Based on the described operational mechanism, it is apparent that to trigger alarm 4, the alarm device of the present invention requires double activations, i.e., orientational sensor and time sensor, which operate by two separate mechanisms.

The predetermined timing threshold can be set by the user depending on a particular application that the orientation/time sensing alarm device is used for. Sensitivity and precision of the timing sensor can also be selected. The time interval can be millisecond, second, minute, or hour, depending on the specific situation. In one extreme, if the timing threshold is set to zero from the activation of the timing sensor, device 1 becomes an orientation sensing only alarm.

Alarm 4 of the orientation/time sensing alarm device can generate audio signals, light signals, or combination of both. The alarm can also generate audio or light signals with different pitches, colors, intensities, and frequencies.

In an additional embodiment, the time sensor can further measure the time period after alarm 4 is activated. For example, if alarm 4 initially generates low intensity and less frequent audio signals immediately after activation, when the time period after activation passes a certain predetermined value, alarm 4 can produce further enhanced audio signals with different intensity or frequency. If the time sensor function is provided through a microprocessor as described previously, measurements of different periods of time, and control of alarm activation accordingly can be conveniently programmed.

The orientation/time sensing alarm device of the present invention can be utilized as a reminding device, particularly suitable for reminding a golfer of a misplaced golf club when it is adapted to a golf club.

Figure 3:
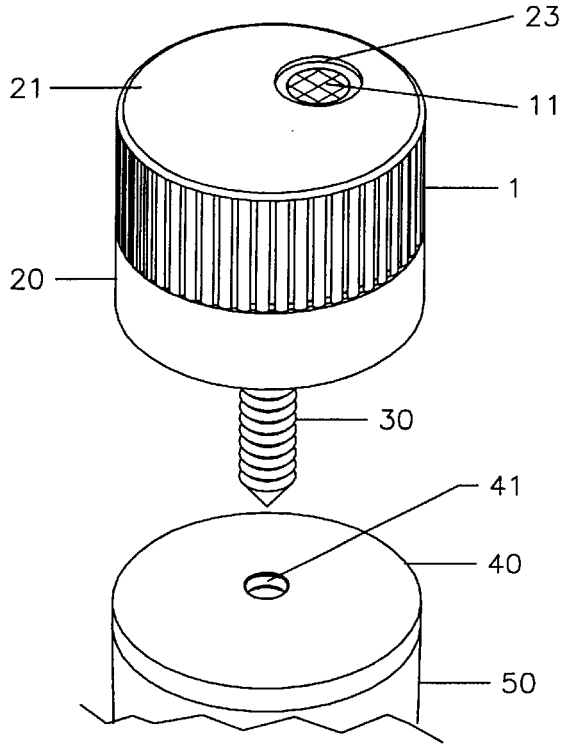
FIG. 3 is a perspective view of the orientation/time sensing alarm device of one embodiment, which is adaptable to a golf club.

FIG. 3 shows an orientation/time sensing alarm device 1 of one embodiment adaptable to a golf club. As shown, to the end of the golf club grip 50 it is assembled an attachment layer 40. Attachment layer 40 has a central hole for adapting device 1 through threaded stud 30. As discussed previously, other suitable attachment means can also be used. Dimension, shape and color of cover 20 can be designed to match those of the golf club grip. Once device 1 is assembled to the golf club, it becomes an integral part of the grip. Since device 1 can be small structurally, its attachment to the golf club only slightly extends the grip, hence, it has minimal impact to the golf club designs and the club's functions. Therefore, the orientation/time sensing alarm device of the present invention can be sold as an add-on product to existing golf clubs. Alternatively, for new golf clubs the orientation/time sensing alarm device can be built into the golf clubs by the manufacturers.

For use as a golf club reminder, it is preferred that the on/off switch is light sensor 11. Because usually after use the golf clubs are stored in a golf club bag, the grips are in the deep end of the bag in the dark. Therefore, light sensor 11 automatically deactivates the orientation/time sensing alarm device when a golf club is in storage. When a golf club is in use, it is exposed to natural sun light, and light sensor 11 automatically activates the orientation/time sensing alarm device.

Figure 4:
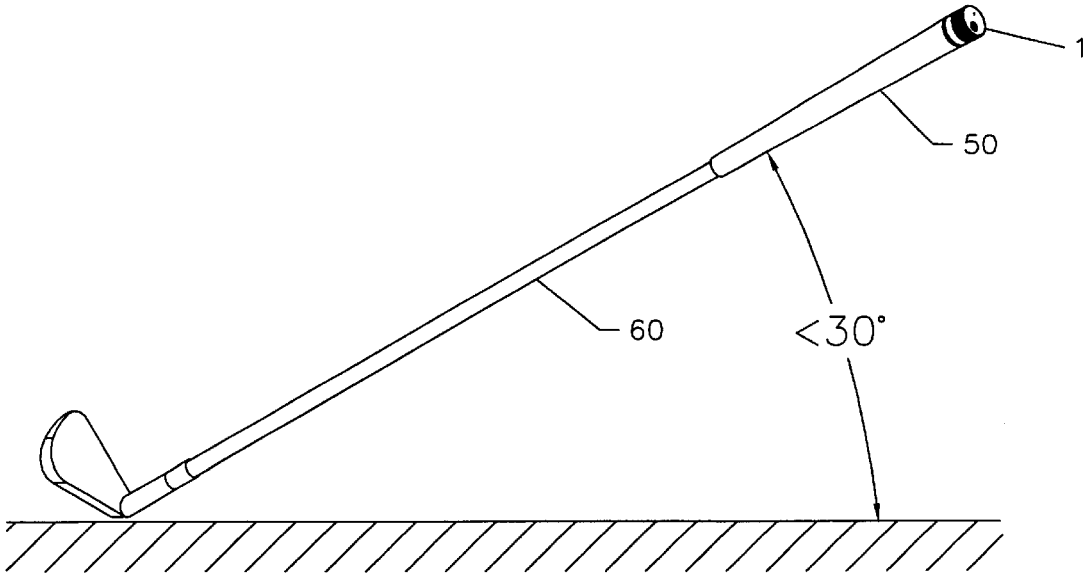
FIG. 4 is a perspective view of a self-reminding golf club at a certain angle from the horizontal plane, having an orientation/time sensing alarm device attached to the end of the golf club grip.

FIG. 4 shows a self-reminding golf club 60 with an orientation/time sensing alarm device attached to the end of the golf club grip 50. The club is positioned with an angle of less than 30 degree from the horizontal plane, a most likely position when a club is laid on the ground. Since device 1 is installed coaxially with the golf club grip, orientation sensor 2 senses the same direction of the golf club grip. In this application, if an orientational threshold of device 1 is set at 30 degree, orientation sensor 2 senses the golf club being in a direction with an angle less than 30 degree from the horizontal plane, it activates time sensor 3. If the golfer forgets to retrieve golf club 60 after his play and let it laid on the ground for a period time beyond a predetermined time threshold set on the time sensor, for instance, five minutes, alarm 4 will be activated to generate audio signals to reminder the golfer.

In this situation, it should be understood that previously broadly described device 1 being positioned above a predetermined orientational threshold means here that device 1 is in a direction with an angle from a horizontal plane less than a predetermined threshold angle.

The orientation/time sensing alarm device of the present invention is advantageous in comparison to the prior art transmitter/transceiver based system. The instant device does not require a transceiver carried by the golfers, by the golf carts, or golf bags. Different from transmitters which operate continuously and demand power supply constantly, the instant device is more energy saving because only the orientation sensor is in function for most of the time when the device is switched on. Furthermore, in combination with the built-in light sensor as power switch of the device, the present invention provides a convenient self-functioning alarm device with minimum user's attention.

It is apparent that the orientation/time sensing alarm device of the present invention can also be used as a reminding device in many other applications other than golf club. For instance, it can be used with expensive portable equipments used by engineers, or personal belongings. In general, if orientational information can be an indicator of the status of an item, the orientation/time sensing alarm device of the present invention can be a suitable reminding device.

The orientation/time sensing alarm device can be sold as a kit, with one or more the orientation/time sensing alarm device in a package. The kit can further comprise suitable attachment means if it is separate from the device. The kit can also include instructions on how to use the device and how to set the threshold for a particular application.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. An orientation/time sensing alarm device adaptable to a golf club comprising:

(a) a light, sensor, wherein the light sensor activates the orientation/time sensing alarm device when the light sensor receives a light signal above a predetermined light signal threshold, (b) an orientation sensor, connecting to the light sensor, (c) a time sensor connecting to the orientation sensor, wherein the time sensor is activated by the orientation sensor when the orientation sensor senses the golf club being positioned in a direction with an angle from a horizontal plane less than the predetermined threshold angle, and (d) an alarm connecting to the time sensor, and forming a circuitry with (a), (b) and (c), wherein the alarm is activated when the time sensor senses a duration of activation of the time sensor being above a predetermined timing threshold.

2. The orientation/time sensing alarm device of claim 1, wherein the orientation sensor is a tilt sensor which closes the circuitry when the golf club is in a direction with an angle from a horizontal plane less than the predetermined threshold angle.

3. The orientation/time sensing alarm device of claim 2, wherein the time sensor measures a time period from the moment when the time sensor is activated by the orientation sensor, and activates the alarm when measured time period is above the predetermined timing threshold.

4. The orientation/time sensing alarm device of claim 3, wherein the time sensor further measures a time period from the moment when the alarm is activated, and changes the alarm to a different operation mode when measured time period is above a predetermined alarming time period.

5. The orientation/time sensing alarm device of claim 3, wherein the alarm generates a signal selected from the group consisting of an audio signal, a light signal, or combination thereof, when the alarm is activated by the timing sensor.

6. The orientation/time sensing alarm device of claim 5, wherein the alarm device is built in a grip of a golf club for reminding a golfer of a mis-placed golf club.

7. The orientation/time sensing alarm device of claim 5 further comprising a cover encasing the orientation sensor, the time sensor, and the alarm.

8. The orientation/time sensing alarm device of claim 7 further comprising an attachment means for connecting the alarm device to a grip of a golf club.

9. A self-reminding golf club comprising:

a golf club, and an orientation/time sensing alarm device connected to a grip of the golf club, wherein the orientation/time sensing alarm device comprises:

(a) a light sensor, wherein the light sensor activates the orientation/time sensing alarm device when the light sensor receives a light signal above a predetermined light signal threshold, (b) an orientation sensor, connecting to the light sensor, (c) a time sensor connecting to the orientation sensor, wherein the time sensor is activated by the orientation sensor when the orientation sensor senses the golf club being positioned in a direction with an angle from a horizontal plane less than the predetermined threshold angle, and (d) an alarm connecting to the time sensor, and forming a circuitry with (a), (b) and (c), wherein the alarm is activated when the time sensor senses a duration of activation of the time sensor is above a predetermined timing threshold.

10. The golf club of claim 9, wherein the orientation sensor is a tilt sensor which closes the circuitry when the golf club is positioned in a direction with an angle from a horizontal plane less than the predetermined threshold angle.

11. The golf club of claim 9, wherein the time sensor measures a time period from the moment when the time sensor is activated by the orientation sensor, and activates the alarm when measured time period is above the predetermined timing threshold.

12. The golf club of claim 9, wherein the alarm generates a signal selected from the group consisting of an audio signal, a light signal, or combination thereof, when the alarm is activated by the timing sensor.

* * * * *